US010455921B2

(12) United States Patent
Kesler

(10) Patent No.: US 10,455,921 B2
(45) Date of Patent: Oct. 29, 2019

(54) ROLL-UP MAT WITH STORAGE

(71) Applicant: James R Kesler, Chino, CA (US)

(72) Inventor: James R Kesler, Chino, CA (US)

( * ) Notice: Subject to any disclaimer, the term of this patent is extended or adjusted under 35 U.S.C. 154(b) by 28 days.

(21) Appl. No.: 15/493,046

(22) Filed: Apr. 20, 2017

(65) Prior Publication Data

US 2017/0303668 A1 Oct. 26, 2017

Related U.S. Application Data

(60) Provisional application No. 62/325,861, filed on Apr. 21, 2016.

(51) Int. Cl.

| | |
|---|---|
| ***A45C 7/00*** | (2006.01) |
| ***A45C 9/00*** | (2006.01) |
| ***A45F 3/02*** | (2006.01) |
| ***A45F 4/02*** | (2006.01) |

(52) U.S. Cl.

CPC ..... *A45F 3/02* (2013.01); *A45C 7/0054* (2013.01); *A45C 7/0095* (2013.01); *A45C 9/00* (2013.01); *A45F 4/02* (2013.01)

(58) Field of Classification Search

CPC .. A45C 11/20; A45C 3/04; A45C 7/00; A45C 9/00; A63H 33/00; A47G 9/06

See application file for complete search history.

(56) References Cited

U.S. PATENT DOCUMENTS 4,068,786 A * 1/1978 Taniguchi ..... A45C 9/00 150/108
4,188,988 A * 2/1980 Agyagos ..... A45C 3/00 190/2
4,324,111 A * 4/1982 Edwards ..... B65D 81/3872 53/410
4,489,815 A * 12/1984 Martinez ..... A45C 9/00 190/1
4,841,587 A * 6/1989 Carter ..... A45C 3/10 455/344
4,858,444 A * 8/1989 Scott ..... A45C 11/20 62/372
4,967,986 A * 11/1990 Schildkraut ..... A45C 3/10 224/223
5,002,401 A * 3/1991 Blackman ..... A45C 7/0095 150/112
5,199,120 A * 4/1993 Holmes ..... A45F 4/06 190/2
5,346,308 A * 9/1994 Buhot ..... A45C 3/10 224/153
5,370,460 A * 12/1994 Nelson ..... A45F 4/02 383/4
5,582,028 A * 12/1996 Rilling ..... A45C 7/0095 62/457.4

(Continued)

*Primary Examiner* — Brian D Nash
(74) *Attorney, Agent, or Firm* — Progress Patent Law, PLLC; David R. McKinney

(57) ABSTRACT

A roll-up mat with storage includes a flexible mat, configured to lie flat for use with an activity surface facing up, and a storage container, enclosing an interior space. The storage container has two end walls, connected by at least one side wall, and an opening, in at least one of the at least one side walls. The flexible mat is attached to the container near the opening and is configured to selectively wrap around the container to a closed position covering the opening, with the activity surface facing the interior space.

18 Claims, 6 Drawing Sheets

(56) References Cited

U.S. PATENT DOCUMENTS 5,622,300 A * 4/1997 Robinson ..... A45C 3/10 190/2
D381,199 S * 7/1997 Glasser ..... D3/274
D421,178 S 2/2000 Dandini
6,135,635 A * 10/2000 Miller ..... A45F 4/02 224/584
6,146,238 A 11/2000 Daiber
6,276,828 B1 * 8/2001 Otley ..... A45C 9/00 224/576
6,393,638 B1 * 5/2002 MacColl ..... A45F 4/02 383/4
D482,224 S 11/2003 DeCet
6,640,359 B1 * 11/2003 Alane ..... A47G 27/0237 5/417
6,952,845 B1 * 10/2005 Akkad ..... A45F 4/02 383/4
7,007,322 B2 * 3/2006 Alane ..... A47G 27/0237 5/417
7,028,870 B2 * 4/2006 Valdez-Campbell ..... A45C 7/0095 224/153
D523,636 S 6/2006 Wilmink
7,058,997 B1 * 6/2006 Klinger ..... A45F 4/08 190/18 A
7,143,932 B2 12/2006 Wang
7,188,713 B1 3/2007 Espar et al.
7,225,483 B1 * 6/2007 Remblad ..... A45F 4/06 383/4
7,377,692 B1 * 5/2008 Troncoso ..... A45C 11/20 150/154
7,597,209 B2 10/2009 Rothschild et al.
7,597,478 B2 * 10/2009 Pruchnicki ..... A45C 7/0077 224/578
7,690,963 B2 4/2010 Whitehead
7,845,508 B2 * 12/2010 Rothschild ..... A45C 7/0054 220/7
D644,865 S * 9/2011 Trout ..... D6/582
9,028,383 B2 * 5/2015 Carrasca ..... A63B 6/00 482/142
9,084,459 B2 7/2015 Fazackerley et al.
2008/0050050 A1 2/2008 Seecof
2009/0120978 A1 5/2009 Lesser
2011/0014843 A1 1/2011 Russell et al.
2011/0042428 A1 2/2011 Ranciato
2012/0125957 A1 5/2012 Barber
2015/0173473 A1 6/2015 Jenkins

* cited by examiner

ROLL-UP MAT WITH STORAGE

PRIORITY CLAIM

The present application claims the benefit of U.S. Provisional Patent Application Ser. No. 62/325,861, filed on Apr. 21, 2016 and entitled ROLL UP MAT WITH STORAGE, the contents of which are incorporated herein by reference in their entirety.

BACKGROUND

Field of the Invention

The present disclosure relates generally to multi-purpose storage devices. More particularly, the present disclosure provides a container with an integrated, roll-up mat that can provide a play or work surface for use with items stored in the container, the mat also functioning as a closeable cover for the container.

Related Art

Children and adults frequently engage in activities or hobbies that involve many parts, supplies and the like, which it is desirable to store in a container of some kind after use. For example, it is generally considered desirable that children put away their toys and games after playing, but this can be difficult to accomplish because of the effort involved. Children generally do not like to clean up.

There are a number of common approaches to this issue. One common approach is to encourage, praise, reward or threaten children with consequences if they do not clean up, but this is often ineffective and can result in strife or other undesirable conditions. Having a toy box or storage container is helpful in this regard, but clean-up still generally requires picking up every toy, puzzle piece, or small game piece and placing it into the box or storage container.

In truth, adults do not usually enjoy cleaning up, either. Adults often enjoy craft and hobby activities that involve many supplies, tools and parts. These can include hobbies such as sewing, knitting, scrapbooking, electronics, model building, etc. With these and other types of activities it is desirable to have a work space and work surface for the activity, as well as a container or storage space for the supplies and tools. It can also be desirable that the container is easily portable.

Moreover, in many activities it is desirable that the work space have special attributes, such as a hard cutting surface or a heat-resistant surface, or have resistance to glue, paint, solvents or other substances. These attributes can facilitate the activity, while simultaneously preventing damage to the work surface or damage to an underlying support surface, such as a table top. Nevertheless, clean-up time is still often viewed as a nuisance, and tends to either diminish the time available for the activity, and its satisfaction, or contribute to unsightly clutter and other undesirable effects.

The present application is directed to one or more of the above issues.

SUMMARY

It has been recognized that it would be advantageous to have some sort of system or apparatus that makes picking up items like toys, games, crafts and hobby supplies fun and easy.

It has also been recognized that it would be advantageous to have an apparatus that makes it easy to transport these items in a case or container.

It has also been recognized that it would be advantageous to have a storage container that also provides a suitable work or activity surface for games, hobbies, crafts and the like.

In accordance with one embodiment thereof, the present disclosure provides a roll-up mat with storage, including a flexible mat, configured to lie flat for use with an activity surface facing up, and a storage container, enclosing an interior space. The storage container has two end walls, connected by at least one side wall, and an opening, in at least one of the at least one side walls, the flexible mat being attached to the container near the opening and configured to selectively wrap around the container to a closed position covering the opening, with the activity surface facing the interior space.

In accordance with another aspect thereof, the invention provides a combination activity and storage device, having a substantially prismatic storage container enclosing an interior space. The storage container has opposing polygonal end panels fixedly attached by rectangular side panels, an opening in at least one of the side panels, a flexible cover, hingedly attached to the container near the opening, and a closure mechanism, associated with a distal end of the flexible cover. The cover includes a plurality of parallel rectangular segments, flexibly attached together and providing an activity surface. The closure mechanism is configured to releasably fasten the flexible cover in the closed position. The cover is moveable from a first open position, in which the plurality of segments lie flat with the activity surface facing up, and a second closed position, in which the flexible cover wraps around at least some of the side panels and covers the opening, with the activity surface facing the interior space.

In accordance with yet another aspect thereof, the invention provides a container, having at least one side panel, with opposing ends and sides, and a pair of polygonal end panels with edges, one edge of each end panel being attached to one of the opposing ends of each of the at least one side panels. A flexible mat is integrally hingedly attached to one of the plurality of side panels, and includes a plurality of generally flat, parallel segments, flexibly attached together. The mat is moveable from a first open position, in which the plurality of parallel segments lie flat and provide an activity surface, and a second closed position, in which the parallel segments of the mat are sequentially disposed perpendicular to the succeeding edges of the end panels at least until meeting an opposing side of the at least one side panel. In the closed position, the mat encloses an interior container space bounded by the end panels, the at least one side panel and the plurality of parallel segments, with the activity surface facing the interior.

BRIEF DESCRIPTION OF THE DRAWINGS

Additional features and advantages of the invention will be apparent from the detailed description which follows, taken in conjunction with the accompanying drawings, which together illustrate, by way of example, features of the invention, and wherein.

DETAILED DESCRIPTION

Figure 1:
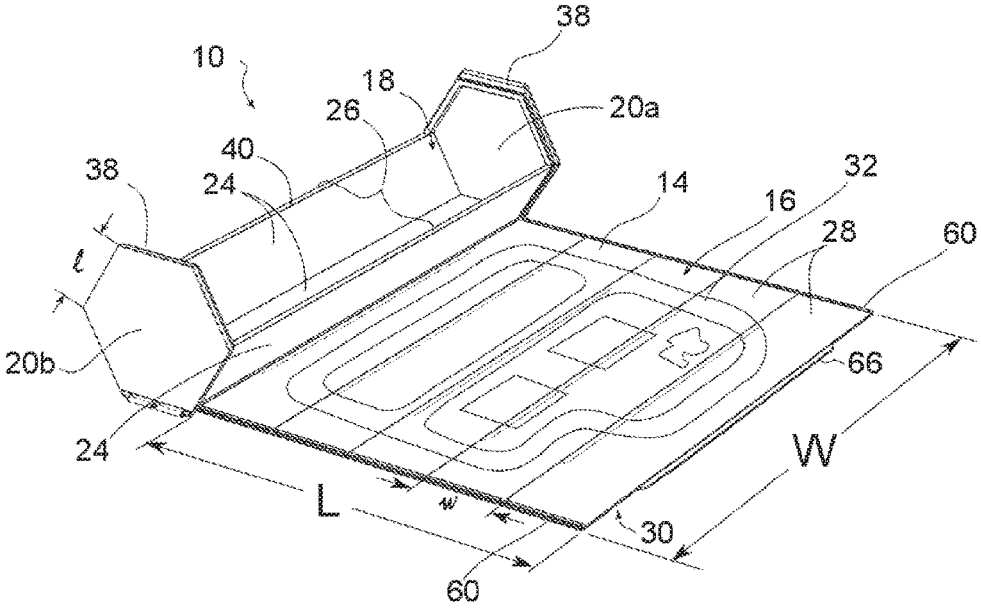
FIG. 1 is a perspective view of an embodiment of a roll-up mat with storage device in accordance with the present disclosure, with the mat rolled out flat.
Figure 2:
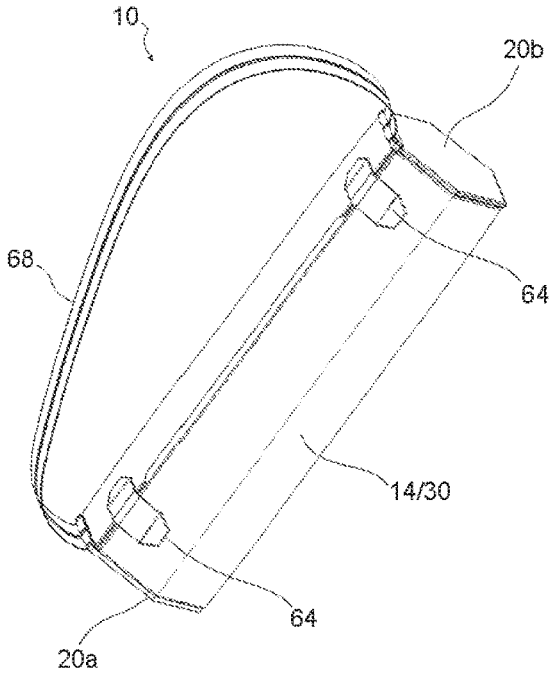
FIG. 2 is a perspective view of the device of FIG. 1, with the mat rolled up and covering the container.

Reference will now be made to exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As discussed above, it would be desirable to have an apparatus that provides an all-in-one portable container and activity mat that makes it easy and fun for kids to clean up their toys, and that can also be used for hobby and craft supplies, tools, etc. Advantageously, the present disclosure addresses these issues by providing a portable storage container with a roll-out mat that unfolds to create a substantially flat play or work surface, which avoids some of the problems or deficiencies associated with prior solutions. The device can be variously described as a container with a flexible roll-out cover, or as a roll-up mat with storage. The device promotes and facilitates the use of the items stored in the container, and simplifies the task of clean-up and storage when done. The apparatus fulfills the need for a portable storage device that correspondingly provides a play/work area for toys and crafts that enables easy cleanup.

Shown in FIGS. 1-5 are various views of an embodiment of a roll-up mat with storage device in accordance with the present disclosure. The device provides a generally tubularly shaped container 10 when in its closed and folded state, as shown in FIGS. 2-5, with a flexible mat 14 that is attached to the storage container 10 and is configured to roll out and lie flat to provide an activity surface 16, which can also be called a work/play surface 16, as shown in FIG. 1. The storage container 10 encloses an interior space, indicated at 18, that is suitable for storing items to be used on the flexible mat 14 or otherwise. The device 10 can thus be generally considered a combination activity and storage device or as a mat and storage container.

The container 10 includes a pair of end panels 20*a*, 20*b*, and a sidewall 22. In the embodiment of FIGS. 1-5, the container 10 is of a substantially prismatic shape, with opposing polygonal end panels or end walls 20*a*, 20*b* attached to the sidewall, which in this embodiment includes multiple flat side panels 24 that each have a generally rectangular shape. The end walls 20 can be fixedly attached to the side panels 24, as in this embodiment, or their connection can be flexible, as in other embodiments discussed below. The container 10 includes an opening, indicated at 26, in at least one of the side wall panels 24 to allow access to the contents of the container 10. In the configuration of FIG. 1, when open, the device 10, particularly the mat 14, is mostly folded flat, but the container 10 retains a partially enclosed interior space or volume 18 to hold items not immediately being used on the activity surface 16.

The flexible mat 14 in this embodiment includes a plurality of generally flat parallel segments 28 that are flexibly attached together, and lie flat in a connected array when the mat 14 is rolled out to the open position. The mat 14 includes an activity surface 16 and an exterior surface 30. When the container 10 is open, the activity surface 16 faces up for use, and the exterior 30 surface can rest upon a support surface, such as a table (not shown). To close the container 10, the segmented flexible mat 14 wraps around the container 10 to cover the container opening 26, thereby enclosing the interior storage cavity 18. When the container 10 is closed, the activity surface 16 is oriented toward the interior 18 of the container 10, and the exterior surface 30 faces outward.

The activity surface 16 can include a variety of desirable features, such as decorative or functional indicia. For example, as shown in FIG. 1, the activity surface 16 can be decorated with indicia, indicated generally at 32, which can be adapted to provide a creative play surface for use with toys, for example. Alternatively, the activity surface 16 can be adapted to work as a craft or hobby surface with markings, gradations, alignment features, fixed tools or other features, as shown at 34 in FIG. 11A. The activity surface 16 can have a variety of other special attributes if desired, such as a hard surface portion to provide a cutting surface or a heat-resistant surface, for example. The embodiment depicted in FIGS. 7A and 7B includes rigid panels 36 that can have these attributes. Additionally, or alternatively, the activity surface 16 in particular, or the flexible mat 14 in general, can be made to have resistance to glue, paint, solvents or other substances. These and other possible attributes can facilitate the activity, while simultaneously preventing damage to the work surface 16 or damage to an underlying support surface, such as a table top.

The mat 14 and activity surface 16 can include a wide variety of other features and/or characteristics. For example, the segments 28 of the mat 14 can be part of or include a video or computer display (e.g. an LCD screen, touch-screen, etc.), electronic paper, backlighting, etc. Other features can also be included, such as a white board or other erasable writing surface, a magnetic surface, a magnetophoretic drawing surface like the Magna-Doodle® drawing device, etc. One possible configuration could include a magnetophoretic drawing surface, with a toy car that a user can move over the surface, and which will create the appearance of a road as it moves. There are many other possibilities.

In the embodiment of FIGS. 1-5, the container 10 has a polygonal cross-sectional shape, though it is to be understood that other shapes can also be used, as discussed below. The shape of the container ends 20 generally determines the profile shape. Suitable polygonal shapes include square (FIGS. 11A-D), hexagonal (FIGS. 1-5) and octagonal (not shown). The specific shape can be chosen for various reasons, such as to obtain a desirable ratio of perimeter to interior volume 18 of the container 10. This ratio will affect the usable area of the activity surface 16 of the unfolded mat 14 compared to the storage volume 18 of the closed container 10.

The mat 14, being a flexibly connected series of generally flat parallel segments 28, can have segments 28 that are shaped or sized to match up with the sides or edges 38 of the polygonal end panels 20. Thus, the mat 14 shown in FIG. 1 is particularly useful for a container 10 having polygonal end walls 20, and can provide a very useful activity surface 16. For example, the parallel segments 28 of the flexible mat 14 can each have a width w that generally corresponds to a length l of a side edge 38 of the polygonal end wall 20 against which that segment 28 will lie when the mat 14 is wrapped around the container 10 in the closed position. In this configuration, when the mat 14 is wrapped around the container 10 to close it, the parallel segments 28 of the mat become sequentially disposed perpendicular to the succeeding edges 38 of the polygonal end panels 20 at least until meeting an opposing side edge 40 of the opening 26 or the side panel 24 on the opposite side of the opening 26, thereby enclosing the interior space 18 of the container 10. Thus, the interior space 18 is bounded by the end panels 20, the side panel(s) 20 and (at least at the location of the opening 26) by at least some of the segments 28 of the mat 14.

Figure 6:
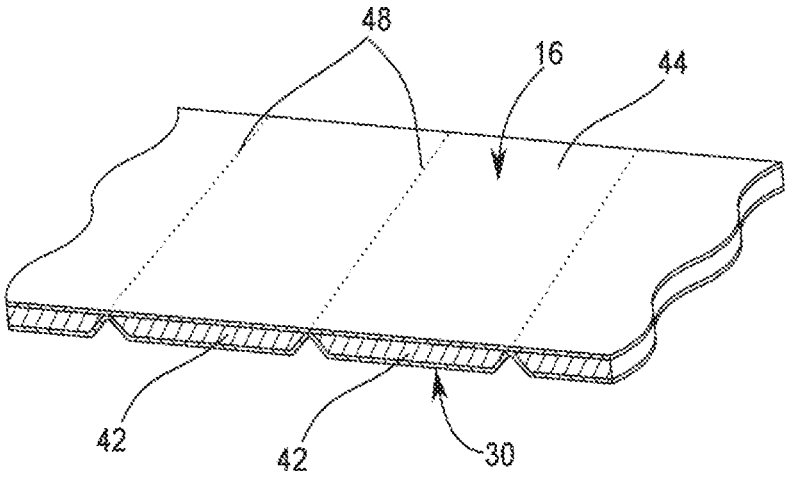
FIG. 6 is a cross-sectional view of a portion of the mat of the device of FIG. 1, having rigid panels encased in fabric.

The flexible attachment of the panels 28 of the mat 14 can be accomplished in several ways. In one embodiment, shown in cross-section in FIG. 6, the parallel segments 28 are substantially rigid rectangular panels 42 encased within a flexible fabric 44, such as woven fabrics, including nylon, canvas, etc., and flexible polymers, such as vinyl. The fabric covering 44 is divided into pockets, indicated generally at 46 (e.g. by stitching, heat fusing, etc.) that hold the rigid panels 42 in place, with the fabric 44 between the pockets being able to flex, as indicated by the dashed fold line at 48, thus allowing adjacent panels 28 to lie flat when desired, and also to pivot relative to each other when desired.

The rigid panels 42 can be stiff cardboard (e.g. comparable to boards for hardbound book covers), thin plywood sheets (e.g. ⅛" in. thick), or a polymer sheet (e.g. polypropylene, polyethylene, etc.) of comparable thickness and/or stiffness, or other thin and relatively stiff materials. Metal panels and panels of other materials can also be used if desired, though it will be apparent that the weight, stiffness and cost of the panels 42 will be relevant factors in selecting the material.

Figure 7A:
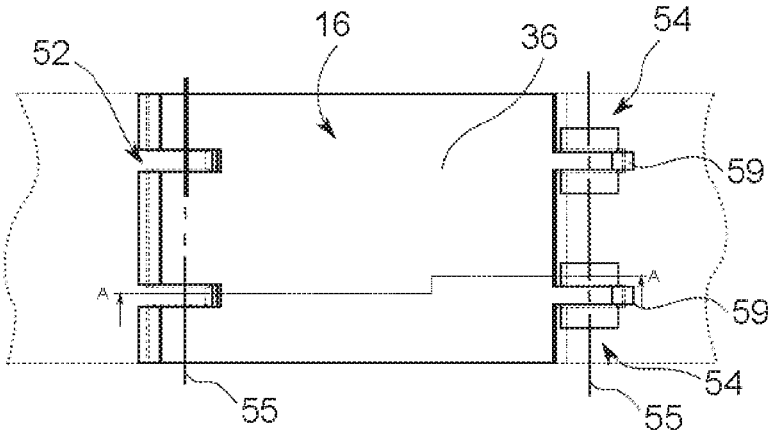
FIG. 7A is a plan view of a single panel of an alternative mat for the device of FIG. 1, having lie-flat hinges to connect the parallel segments of the mat.
Figure 7B:
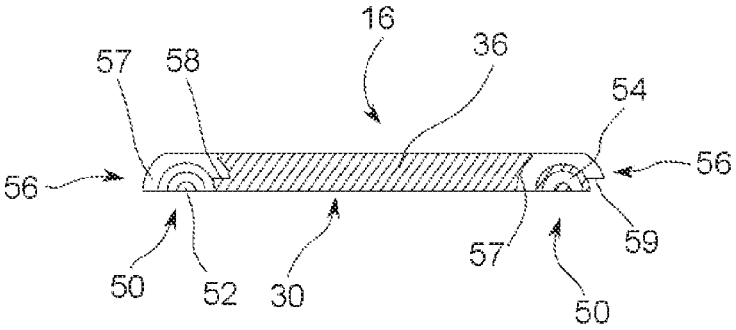
FIG. 7B is a cross-sectional view of the panel of FIG. 7A.

In another embodiment, shown in FIGS. 7A and 7B, the parallel segments 28 are substantially rigid parallel segments 36 that are connected by lie-flat hinges, indicated generally at 50. The lie-flat hinges generally include a semi-curved pin portion 52 and a cup-shaped receiver portion 54. The upper surface of each of the pin portions 52 and the receiver portions 54 are generally flat, so as to be substantially flush with the activity surface 16 of the respective segment 36, and the pivoting axis of the hinge, indicated at 55, is flush with the upper surface 16. The side edges 56 of the segments 36 can have a mating curvature, indicated at 57, so as to minimize pinch points in the hinge mechanism.

Figure 10:
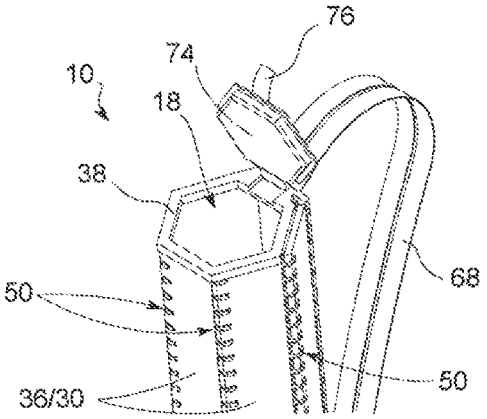
FIG. 10 is an end perspective view of an embodiment of a roll-up mat with storage device in accordance with the present disclosure, having an openable end lid.

By using multiple hinge pieces with flat upper surfaces (the activity surface 16) on each edge of each segment 36, a hinge 50 having a virtual axis is created, essentially providing a half hinge, rather than a hinge with hinge material on both halves of its rotational axis. A perspective view of a container 10 having multiple sides/segments 24/28 attached with type of lie-flat hinge 50 shown in FIGS. 7A-7B is shown in FIG. 10. In this view the mat 14 is in the closed position, wrapped around the container 10 body and disposed against the edges 38 of the end panel 20.

Advantageously, the configuration of FIGS. 7A-B can adapt the device 10 to function as a useful travel container and lap-supported activity surface. In this configuration, the lie-flat hinges 50 include a stop shoulder 58 that is part of the pin portion 52 of the hinge 50 (shown on the left side of FIG. 7B), and a stop bar 59 that is part of the receiver portion 54 of the hinge 50 (visible on the right side of FIG. 7B). The stop shoulder 58 and stop bar 59 specifically limit the rotation of adjacent segments 36 in one direction (the opening direction) to a generally planarly-aligned flat configuration, like that shown in FIG. 1. In this way, the unfolding segments 36 of the mat 14 lock together to provide a generally flat, generally planarly-aligned activity surface 16 as the mat 14 unfolds to provide a lap-stable activity surface 16, which can be used for play, work, drawing, etc.

The size of the flexible mat 14 can vary. Referring again to FIG. 1, the width W of the mat 14 can be such that the ends 60 of the segments 28 of the mat 14 reach to the edges 38 of both end panels 20 when the mat 14 is wrapped around the container 10. The length L of the mat 14 can be such that the mat 14 wraps around the container 10 at least beyond a point of covering the opening 26 (i.e. extending from one side edge 40 of the opening 26 at least to or beyond a point of meeting the opposing side edge 40 of the opening 26). Alternatively, in order to increase the usable unfolded area of the mat 14 without increasing the size and storage volume of the folded container 10, the mat can have a total length L such that multiple layers of the mat 14 and of the workplay surface 16 can be wrapped around the body of the container 10 when in the closed position.

A closure mechanism, indicated generally at 64, is provided at a distal end 66 of the flexible mat 14, and is configured to releasably fasten the flexible mat 14 around the body of the container 10 in the closed position. The closure mechanism 64 can be any suitable device, such as ties, straps, clips, buckles, catches, zippers, snaps, magnets, or hook-and-loop fabric (e.g. Velcro®). Other types of closure mechanisms can also be used. Hook-and-loop fabric is believed to be useful for containers having single or multiple layer flexible mats 14, whether of the segment-type or the flexible fabric-type. The closure mechanism 64 can be configured to attach the distal end 66 of the flexible mat 14 to a side panel 24 of the container 10, to an exterior surface 30 of the flexible mat itself 14 (e.g. where the flexible mat 14 wraps around the container 10 in multiple layers), to the end walls 20 of the container 10 (or their edges 38), or any or all of the above. With any of these closure devices 64 the container 10 can be secured to contain and transport items, and can be unrolled to access the items within, and utilize the activity surface 16.

Figure 3:
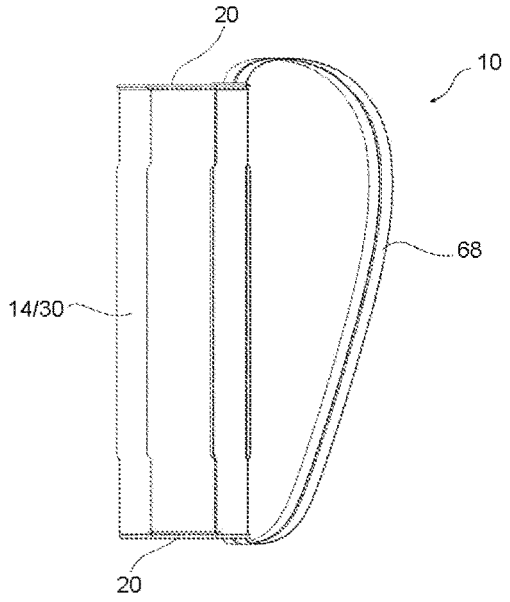
FIG. 3 is a front view of the device of FIG. 1, showing the carrying straps.
Figure 4:
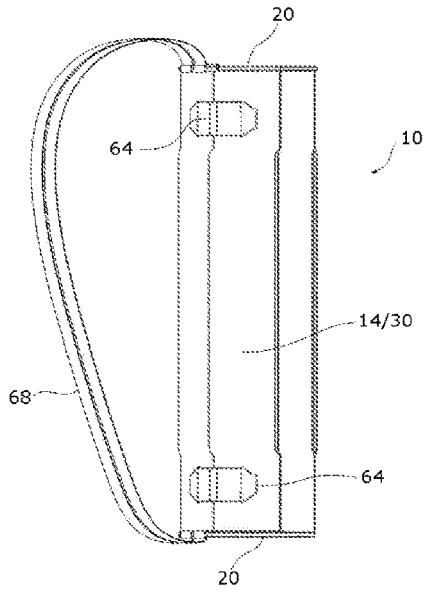
FIG. 4 is a back view of the device of FIG. 1.
Figure 5:
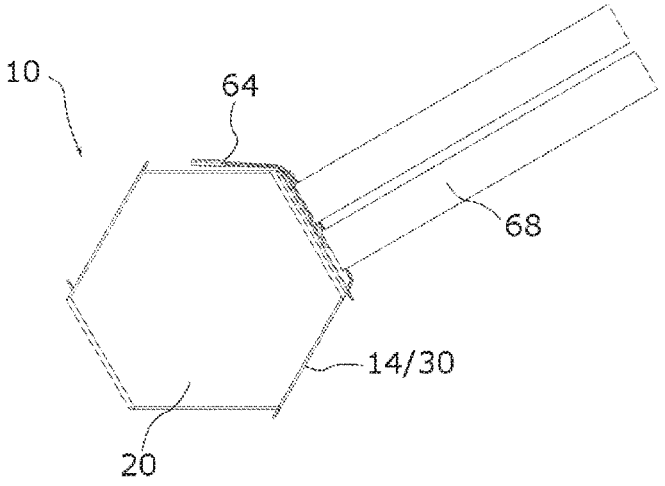
FIG. 5 is an end view of the device of FIG. 1.
Figure 8:
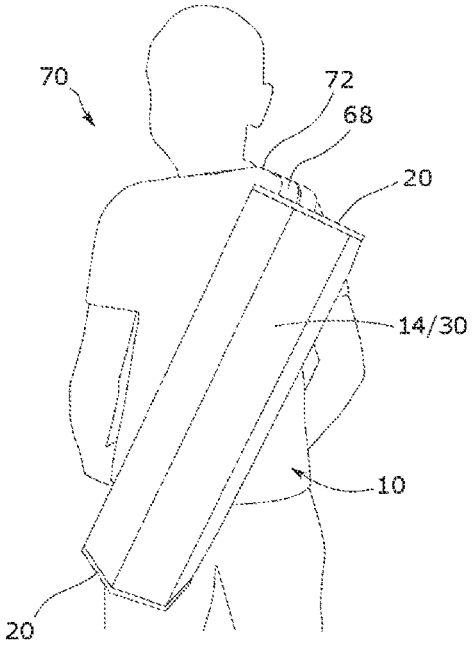
FIG. 8 is a perspective view showing a user carrying the device of FIG. 1 with the carrying straps over one shoulder.

As shown in FIG. 3, the device 10 can also include a carrying strap or straps 68 that is/are attached to the storage container 10, to aid in transportation of the device 10. In this configuration, the container 10 can include a ring (e.g. circular or D-shaped (not shown)) to allow it to be hung from a hook or tethered to other items. The ring can also be used to attach one or more straps 68 to the container 10 for carrying it on a back or shoulder. The carrying strap 68 can be a double strap, as depicted in FIG. 3, or a single strap. The double strap configuration allows carrying the device 10 in the manner of a backpack, with each strap over opposite shoulders of a user. The double or single strap configuration can be used for carrying the device 10 in the manner of a messenger bag. Shown in FIG. 8 is a perspective view of a user 70 carrying the device 10 of FIG. 1 with a double carrying strap 68 slung over one shoulder 72. The container 10 with a double or single carrying strap 68 as depicted in FIG. 3 can also be carried by hand, in the manner of a handbag or duffle bag.

Figure 9:
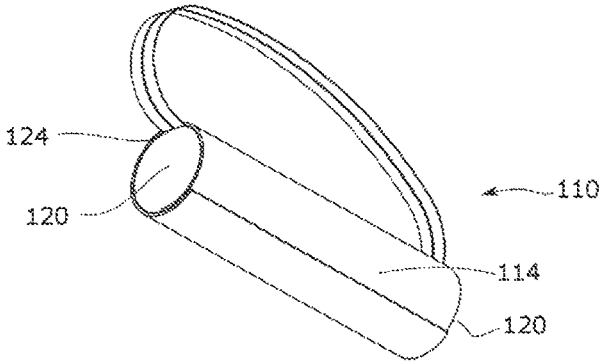
FIG. 9 is a perspective view of another embodiment of a roll-up mat with storage device in accordance with the present disclosure, the container having a circular cross-section.

As noted above, the device 10 disclosed herein can have shapes other than a polygonal cross-section, such as a circular or elliptical cross-section. Shown in FIG. 9 is and embodiment of a roll-up mat with storage 100 having a circular cross-sectional shape. The flexible mat 114 in this embodiment can be of a material that is flexible along its entire length to allow for folding along the circular shaped ends 120. In one embodiment of this, the flexible mat 114 is a generally continuous piece of flexible material (i.e. not including rigid segments), such as canvas, nylon, vinyl, etc., which can wrap around the container 110 when in the closed position, as shown in FIG. 9, and flexibly roll out flat when in the open position (not shown). Alternatively, the flexible mat 114 for a container of a circular or elliptical cross section of this sort can be a flexibly connected series of flexibly-connected rigid parallel segments, like the segments 28 of FIG. 1, as discussed above, but including a larger number of relatively narrow segments (i.e. each segment 28 having a width w that is relatively small), so as to approximately conform to the circular end walls 120 of the container 110.

The circularly-shaped embodiment of FIG. 9 is particularly useful as a large paper carrier or portfolio, for example. For this use the mat 114 can be configured with a clip (not shown), disposed at an edge of the flexible mat 114, that can hold the edge of one or more papers. In the embodiment of FIG. 9 the ratio of perimeter to volume of the container 110 can be chosen to minimize storage volume to a minimally usable amount, while the size of the unfolding mat can provide an activity surface (not shown in FIG. 9) that can be chosen and shaped to conform to various paper formats. In this way the paper-carrier container 110 can be unfolded with papers, providing a clean surface to rest the papers on, and a backing surface (the mat 114) for the paper. The container 110 then folds and rolls with the papers to store and protect them in a minimal volume. To get a desired perimeter-to-volume ratio, the flexible mat 114 can have a length (L in FIG. 1) that produces multiple layers wrapped around the container 110 when in the closed position.

Referring again to FIG. 1, the flexible mat 14 can be attached to the container 10 in any one of many positions, so long as it can function as desired. In general, it is considered desirable to attach the flexible mat 14 adjacent to one side 40 of the opening 26, though it can be attached in other positions. The mat 14 can be hingedly attached or fixedly attached to the container 10, depending upon the configuration of the mat 14. For example, where the mat 14 is configured as in FIG. 1, a proximal one of the flexibly-connected parallel segments 28 can be hingedly attached to a side panel 24 the container 10. Alternatively, where the mat 14 is a single piece of flexible material, as in FIG. 9, it can be fixedly attached to a side panel of the container 110 along a proximal edge, such as by stitching, adhesives, etc., or it can be fixedly attached (either rigidly or flexibly) to a small portion of an edge of the end panels 120, such as at the strap attachment point 124 in FIG. 9.

As another useful feature, the container 10 can include an openable lid 74, disposed at one or both of the end walls 20, as shown in FIG. 10. The openable end lid 74 can provide quick and easy access to the interior volume 18, to allow items to be removed from and added to the container 10 without unfolding the mat 14. The openable end lid 74 can also include a latch 76 for fastening the lid closed.

Figure 11A:
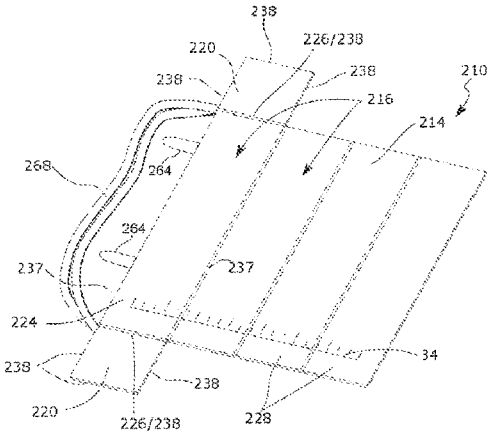
FIGS. 11A-D are perspective views of another embodiment of a roll-up mat with storage device in accordance with the present disclosure, in which the mat and the container entirely roll out flat.

In another embodiment, depicted in FIGS. 11A-D a combination activity and storage device 210 in accordance with the present disclosure can completely unfold into a flat surface in its unfolded state. Like the other configurations discussed above, this embodiment provides a container 210 having a first side panel 224, with opposing ends 226 and sides 237, and a pair of polygonal end panels 220 (in this case, square end panels 220) with edges 238, one edge 238 of each end panel 220 being attached to one of the opposing ends 226 of the first side panel 224. As shown in FIG. 11A, the end panels 220 are flexibly attached to the adjacent side panel 224, and lie down flat when the container 210 is opened to the completely flat state. Alternatively, the end panels 220 can be held upright and rigidly connected to the adjacent end 226 of the first side panel.

The flexible mat 214 includes a plurality of generally flat, parallel segments 228 that are flexibly attached together, as discussed above, and is integrally hingedly attached (e.g. via flexible fabric) to one side edge 237 of the first side panel 224, and provides an upwardly-facing activity surface 216 when the container 210 is open, as shown in FIG. 11A. Unlike the other embodiments disclosed herein, the segments 228 of the mat 214, the side panel 224 and the end panels 220 all fold flat in the open position, so that all portions of the container 210 can function as part of the activity surface 216. This can be desirable for a variety of activities, such as sewing, etc. where a large, unobstructed workspace is desired.

Figure 11B:
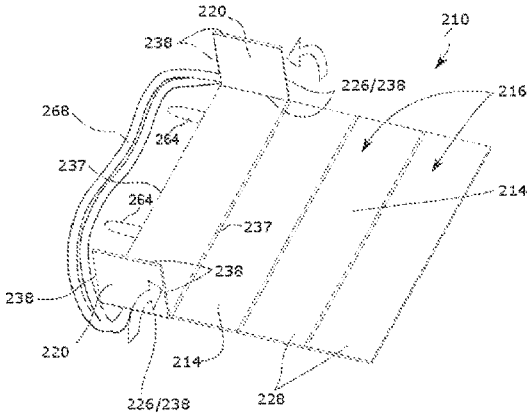
Figure 11C:
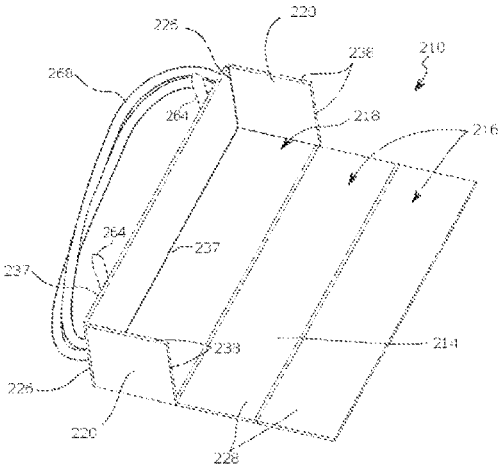
Figure 11D:
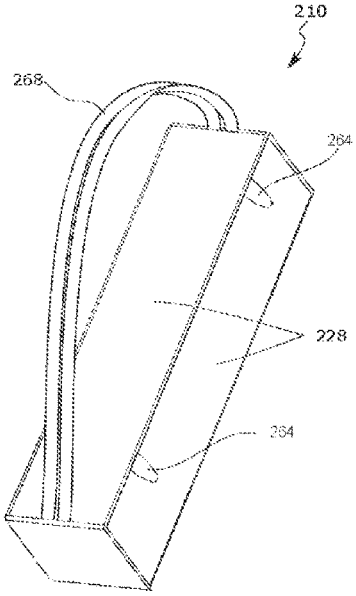

To close the container 210 of FIG. 11A, the end panels 220 are configured to fold up substantially perpendicular to the first side panel 224, as shown in FIG. 11B, and the parallel segments 228 of the mat 214 are configured to sequentially fold up perpendicularly against the succeeding edges 238 of the end panels 220 at least until meeting an opposing side edge 237 of the at least one side panel 224, as depicted by the sequential views of FIGS. 11C and 11D. In this configuration, the parallel segments 228 of the mat 214 effectively become additional side panels 224 of the container, thereby enclosing an interior space (218 in FIG. 11C) that is bounded by the end panels 220, the at least one side panel 224 and the plurality of parallel segments 228, with the activity surface 216 facing the interior 218. Likewise, the first side panel 224 also effectively functions as one of the segments 228 of the mat 214 and thus can provide part of the activity surface 216.

Figure 12:
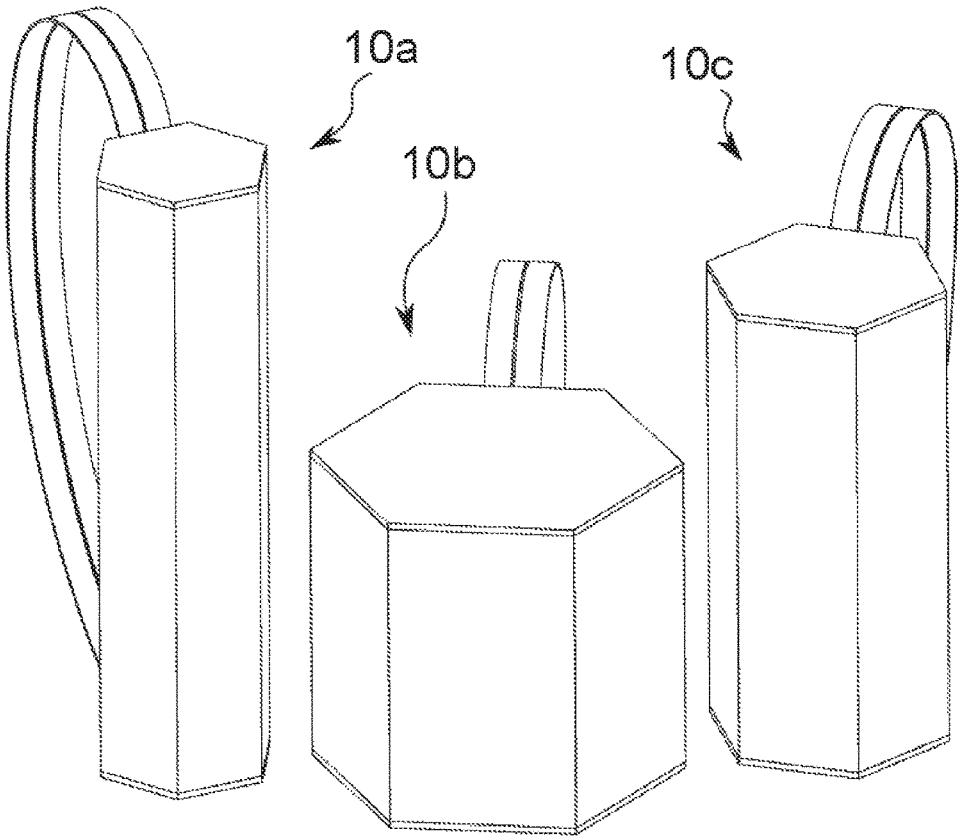
FIG. 12 is a perspective view of various alternative sizes and shapes for the container of the present disclosure.

The roll-up mat with storage disclosed herein can be configured in a variety of sizes, shapes and colors to satisfy a wide variety of desires and uses. For example, as shown in FIG. 12, the container 10 can be tall and slender, as indicated at 10*a*, short and wide as indicated at 10*b*, or have a height to width ratio that is somewhere in between, as indicated at 10*c*. A tall and slender container 10*a* can be useful for papers, architectural drawings and the like, while a short and wide container 10*b* can be useful for hobby or craft use that involves larger tools, parts or accessories.

The device disclosed herein thus provides a portable container that can be opened in a way that allows some or all of the surfaces that make up the sides (and, optionally, the ends) of the container to lie out in a flat configuration, forming a mat or work surface. In the various embodiments shown and described herein the flexible mat unfolds to create a play or work surface that facilitates the activity, while simultaneously easing the process of cleaning up tools, supplies, parts, game pieces, etc. at the end of the activity.

It is to be understood that the above-referenced arrangements are illustrative of the application of the principles of the present invention. It will be apparent to those of ordinary skill in the art that numerous modifications can be made without departing from the principles and concepts of the invention as set forth in the claims.

What is claimed is:

1. A roll-up mat with storage, comprising:

a flexible mat, configured to lie flat for use with an activity surface facing up, the flexible mat comprising a plurality of substantially rigid parallel segments hingedly connected with lie-flat hinges, comprising a stop shoulder and a stop bar, the stop bar being configured to contact the stop shoulder to prevent rotation in one direction of adjacent segments beyond the generally planarly-aligned flat configuration, to limit the rotation of adjacent parallel segments to a generally planarly-aligned flat configuration when fully open; and a storage container, enclosing an interior space, having two end walls, connected by at least one side wall; and an opening, adjacent to the at least one side wall, the flexible mat being attached to the at least one side wall of the container near the opening and configured to selectively wrap around the container to a closed position covering the opening, with the activity surface facing the interior space.

2. A roll-up mat in accordance with claim 1, wherein the end walls are polygonal in shape, having side edges, the segments of the flexible mat having widths that correspond to lengths of adjacent side edges of the end walls when in the closed position.

3. A roll-up mat in accordance with claim 1, wherein the flexible mat wraps around the container beyond a point of covering the opening.

4. A roll-up mat in accordance with claim 1, further comprising a closure mechanism, associated with a distal end of the flexible mat, configured to releasably fasten the flexible mat in the closed position.

5. A roll-up mat in accordance with claim 1, further comprising a carrying strap, attached to the storage container.

6. A roll-up mat in accordance with claim 1, wherein the activity surface includes decorative or functional indicia.

7. A roll-up mat in accordance with claim 1, wherein the substantially rigid panels are encased within a flexible fabric.

8. A roll-up mat in accordance with claim 1, wherein the activity surface includes a hard surface portion.

9. A roll-up mat in accordance with claim 1, further comprising an openable lid, disposed on one of the end walls.

10. A combination activity and storage device, comprising:

a substantially prismatic storage container enclosing an interior space, having opposing polygonal end panels fixedly attached by rectangular side panels;

an opening adjacent to at least one of the side panels;

a flexible cover, hingedly attached to the container near the opening, the cover comprising a plurality of parallel rectangular segments, flexibly attached together and providing an activity surface, the cover being moveable from a first open position, in which the plurality of segments lie flat with the activity surface facing up, and a second closed position, in which the flexible cover wraps around at least some of the side panels and covers the opening, with the activity surface facing the interior space, the rectangular segments being flexibly attached together with lie-flat hinges, comprising a stop shoulder and a stop bar, the stop bar being configured to contact the stop shoulder to prevent rotation in one direction of adjacent segments beyond the generally planarly-aligned flat configuration, to limit the rotation of adjacent parallel segments to a generally planarly-aligned flat configuration when in the open position; and a closure mechanism, associated with a distal end of the flexible cover, configured to releasably fasten the flexible cover in the closed position.

11. A device in accordance with claim 10, wherein the flexible cover wraps around the container beyond a point of covering the opening.

12. A device in accordance with claim 10, further comprising an openable lid, disposed on one of the end panels.

13. A device in accordance with claim 10, wherein the activity surface includes decorative or functional indicia.

14. A container, comprising:

at least one side panel, having opposing ends and sides;

a pair of polygonal end panels with edges, one edge of each polygonal end panel being attached to one of the opposing ends of each of the at least one side panels; and a flexible mat, integrally hingedly attached to one of the plurality of side panels, the mat comprising a plurality of generally flat, parallel segments, flexibly attached together, and being moveable from a first open position, in which the plurality of parallel segments lie flat and provide an activity surface, and a second closed position, in which the parallel segments of the mat are sequentially disposed perpendicular to the succeeding edges of the polygonal end panels at least until meeting an opposing side of the at least one side panel, thereby enclosing an interior container space bounded by the polygonal end panels, the at least one side panel and the plurality of parallel segments, with the activity surface facing the interior, the parallel segments of the mat being flexibly attached together with lie-flat hinges, comprising a stop shoulder and a stop bar, the stop bar being configured to contact the stop shoulder to prevent rotation in one direction of adjacent segments beyond the generally planarly-aligned flat configuration, to limit the rotation of adjacent parallel segments to a generally planarly-aligned flat configuration when in the open position.

15. A container in accordance with claim 14, further comprising a closure mechanism, associated with a distal end of the flexible mat, configured to releasably fasten the flexible mat in the closed position.

16. A container in accordance with claim 14, wherein the flexible mat wraps around the end panels beyond a point of meeting the opposing side of the at least one side panel covering the opening.

17. A container in accordance with claim 14, wherein the activity surface includes decorative or functional indicia.

18. A container in accordance with claim 14, wherein:

the side panel and end panels fold flat in the open position;

the end panels are configured to fold up substantially perpendicular to the side panel; and the parallel segments of the mat are configured to fold up against the edges of the end panels and provide additional side panels to enclose the container when in the closed position.

* * * * *